United States Patent [19]

Contractor et al.

[11] 3,932,915

[45] Jan. 20, 1976

[54] AIR-LAYDOWN APPARATUS FOR FORMING UNIFORM WEBS OF STAPLE FIBERS

[75] Inventors: Rashmikant M. Contractor, Wilmington; Sang-Hak Hwang, Newark, both of Del.

[73] Assignee: E. I. Du Pont de Nemours & Company, Wilmington, Del.

[22] Filed: Aug. 9, 1974

[21] Appl. No.: 497,046

[52] U.S. Cl. ..... 19/156.3

[51] Int. Cl.[2] ..... D01G 25/00

[58] Field of Search ..... 19/155, 156–156.4, 19/88, 89, 86, 105, 96, 205; 156/62.2, 62.4; 425/80–83

[56] References Cited

UNITED STATES PATENTS

| | | | |
|---|---|---|---|
| 2,948,022 | 8/1960 | Day | 19/205 X |
| 3,268,954 | 8/1966 | Voa | 19/156.3 |
| 3,797,074 | 3/1974 | Zafiroglu | 19/156.3 |
| 3,815,178 | 6/1974 | Goldman | 19/156.4 X |

*Primary Examiner*—Dorsey Newton

[57] ABSTRACT

Process and apparatus are disclosed which are suitable for high speed production of uniform, lightweight webs by air-laydown of textile fibers. A toothed disperser roll doffs the fibers into an air stream of high uniform velocity and low turbulence to form a thin fiber stream from which the fibers are deposited in web form on a moving screen. A curved disperser plate, shrouds the disperser roll and prevents premature doffing. By using a disperser plate with a rough surface, preferably one having lateral grooves, web uniformity is remarkably improved.

3 Claims, 8 Drawing Figures

FIG. 2
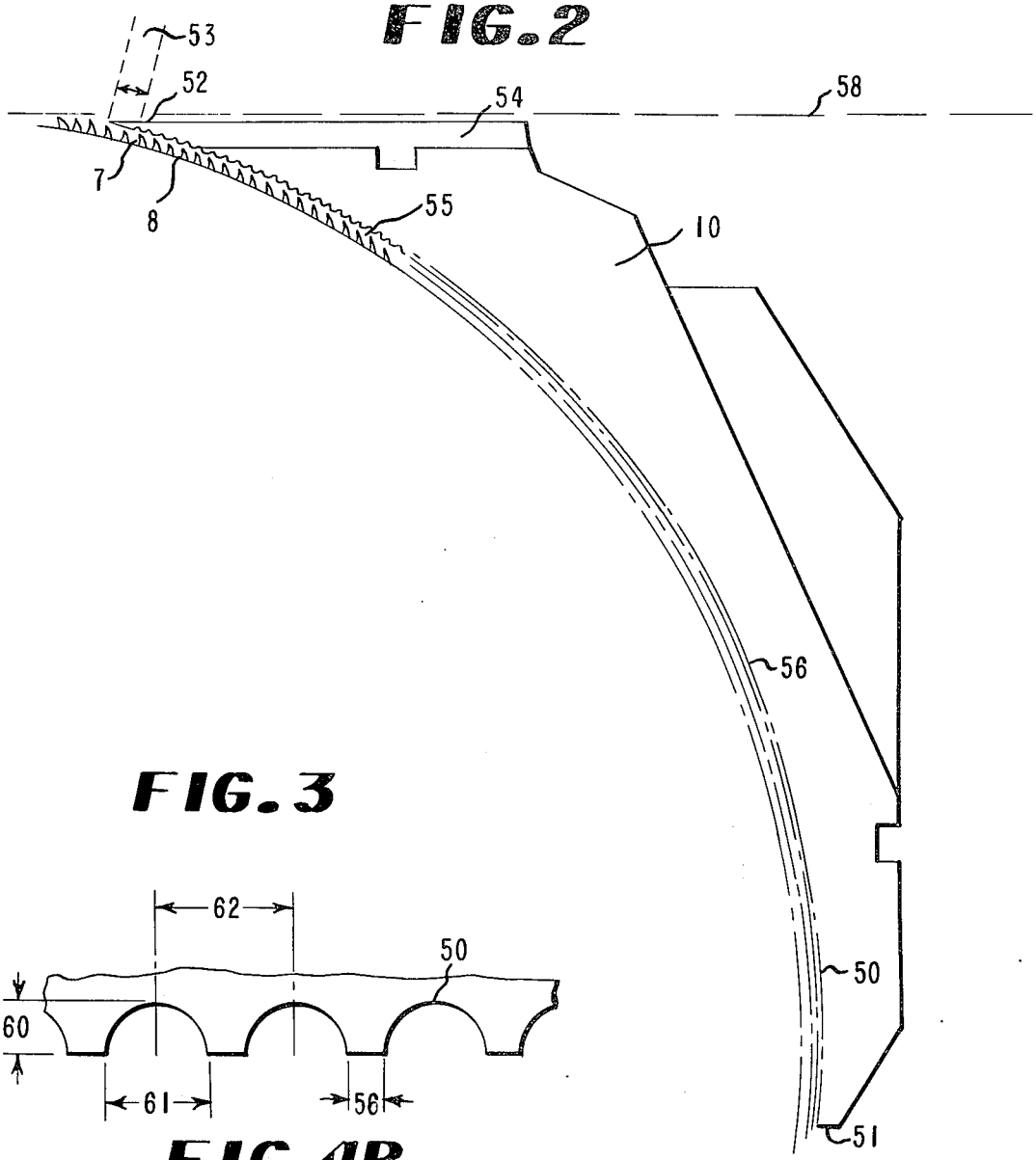
FIG. 3
FIG. 4B
FIG. 4A
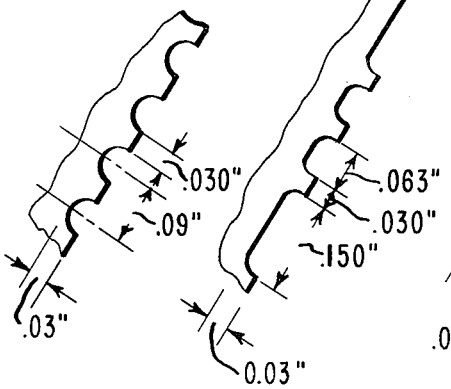
FIG. 4C
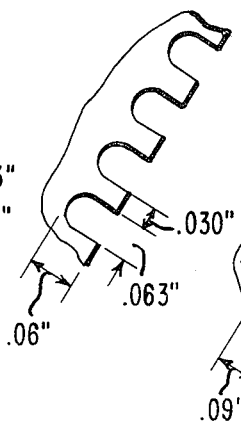
FIG. 4D
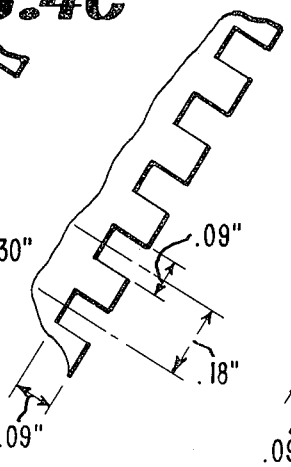
FIG. 4E
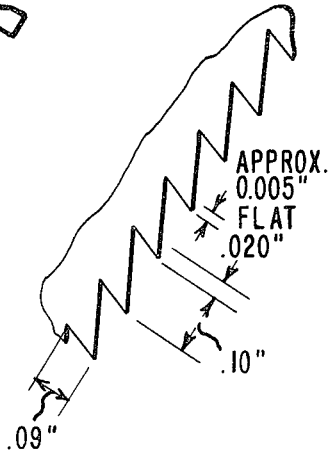

AIR-LAYDOWN APPARATUS FOR FORMING UNIFORM WEBS OF STAPLE FIBERS

BACKGROUND OF THE INVENTION

This invention relates to an air-laydown process and apparatus for assembling textile fibers into webs and is more particularly concerned with improvements in collecting textile fibers to form webs which are suitable for use in producing high quality nonwoven fabric.

Zafiroglu U.S. Pat. No. 3,797,074 discloses a process and apparatus for high speed production of uniform webs from feed batts of staple fibers. The batt is fed into a space between a toothed disperser roll, rotating at a surface speed of at least 3,000 feet per minute, and a stationary, curved disperser plate which is closely-spaced from the disperser roll teeth to hold the fibers close to the roll until a fiber-doffing position is reached at the tip of the disperser plate. At this location the fibers are projected, by tangential ejection from the roll, through an opening into duct means. Air supply directs a stable stream of air, of uniform velocity, low turbulence and low vorticity, through the duct in the direction of movement of the roll surface so that the fibers are projected into the stream at an angle of less than about 25° and preferably less than 12° to the direction of air flow through the duct. The fibers are carried in the air stream to condenser means which separates the fibers from the air to form webs weighing from about 0.1 to 10 ounces per square yard as determined by the relative speeds of the fiber feed and condenser means.

The process of the above patent provides webs which are of high quality relative to webs produced by previous processes. However, the webs are still subject to basis-weight variations which show up in non-woven fabrics prepared from the webs. It has now been found that the variations are caused by non-uniformities in flow of air through the space between the disperser roll and the disperser plate. Hot wire anemometer measurements show a predominant aerodynamic pulsation in the slit between the roll and plate which is at a frequency equal to the roll speed. This air pulsation causes uniformly spaced, cross-directional lines in the web, called chatter marks. Flow vortices having axes along the roll circumference cause machine direction streaks in the web. Non-uniform fiber separation or segregation of fibers into clumps causes blotches in the web. The present invention reduces all three of these types of web variations. Furthermore, the invention provides for the production of uniform webs at higher speeds than have been possible previously. Other advantages of the invention will become apparent from the disclosure and claims.

SUMMARY OF THE INVENTION

The present invention provides, in an air-laydown process for forming a web of staple fibers wherein the fibers are projected into a stable stream of air from the space between a rotating toothed disperser roll and a stationary disperser plate having a curved surface closely-spaced from the disperser roll to hold the fibers close to the roll until projected into the air stream at a tip of the disperser plate, and the fibers are thereafter separated from the air stream to form a web; the improvement for high-speed production of uniform webs wherein the improvement comprises projecting the fibers into the air stream from the space between a rotating toothed disperser roll and a rough-surface disperser plate to generate a high intensity of air turbulence between the surface of the disperser roll and the plate. Grooves which are semicircular in shape and extend continuously across the plate in a direction transverse to the rotational direction of the roll are the most preferred. The grooves may also have other configurations (e.g., rectangular, oval, sawtooth) or combination of several configurations. They may be straight, curved, or zig-zag in their path across the plate. The grooves preferably are straight and extend in a direction at right angles to the rotational direction of the roll. They may also run at other angles as long as they do not run parallel to the rotational direction of the roll, since such parallel grooves would contribute to formation of machine direction (MD) streaks in the web. The grooves are preferably continuous across the disperser plate but they may also be discontinuous. When there are discontinuities in each groove, it is preferred to stagger them in adjacent grooves so that they do not line up to form channels running in the rotational direction of the roll. Such channels would contribute to forming MD streaks as do the aforementioned grooved plates having grooves running parallel to the roll rotation. The plate should have a rough surface at least in the area near the tip of the plate; preferably, grooves are present as close to the extreme tip as possible and over the remaining surface of the plate. In less preferred embodiments, the rough surface is present only in the area near the tip.

In a preferred embodiment, fibers are:

a. fed to a disperser-roll, rotating at a surface speed of 10,000 to 30,000 ft./min. (166–500 ft./sec.)
b. picked up by the teeth of the disperser-roll and conveyed through the space between the roll and the curved surface of a disperser-plate, having a rough surface, to a doffing position at the tip of the disperser plate;
c. projected at an angle of less than 25° into a stream of air, flowing along a duct at a high uniform velocity and low turbulence;
d. conveyed by the airstream and deposited therefrom onto a collecting screen to form a web.

A preferred disperser plate has grooves extending continuously or discontinuously across the plate. Suitable groove dimensions are:

| | |
|---|---|
| Groove depth | 0.010–0.150 in. preferably 0.02–0.10 in. |
| Groove width | 0.010–1.0 inch |
| Center-to-center distance between grooves | 0.02–2 inch |
| Land area between grooves | 0.001–1.5 inch |
| Grooves/inch | 0.5–50 |

A particularly preferred disperser plate has an aluminum face with continuous grooves of semicircular shape, having a depth of about 0.03 inch, a width of about 0.06 inch and a center-to-center spacing of about 0.09 inch. The grooves are present over the entire face of the plate to within about 0.75-inch of the plate tip.

The disperser plate of this invention provides improved web-uniformity in part by generating high frequency air turbulence within the semicircular slit between the disperser-roll and the grooved plate. This can be expressed in terms of "% turbulence", i.e., the root-mean-square-value of the air-velocity, as determined using a hot-wire-anemometer by known techniques as described hereinafter. Such measurements made in the semicircular slit typically show higher values when a plate of this invention is used. For example, in a series wherein various disperser rolls and several roll speeds are used as discussed in greater detail hereinafter, values for "% turbulence" generally increase with web uniformity, and are in the following ranges:

| | % Turbulence |
|---|---|
| Grooved plate: | 18–50 |
| Smooth plate: | 12–22 |

The most uniform webs are obtained when there are large amplitude pulsations at high harmonics and high frequencies and it is believed that these large amplitude pulsations cause the fibers to vibrate within the slit at frequencies sufficient to aid in their more uniform dispersal.

BRIEF DESCRIPTION OF THE DRAWINGS

FIG. 2 is a fragmented longitudinal vertical section of the top portion of the fiber dispersing section, showing the fiber dispersing roll and the grooved disperser plate.

FIG. 3 is an enlarged diagrammatic view showing the grooved surface of the plates in detail.

FIG. 4A–4E show various configurations of grooves in grooved disperser plates suitable for use in the air-laydown system of the present invention.

DETAILED DESCRIPTION OF PREFERRED EMBODIMENTS

Figure 1:
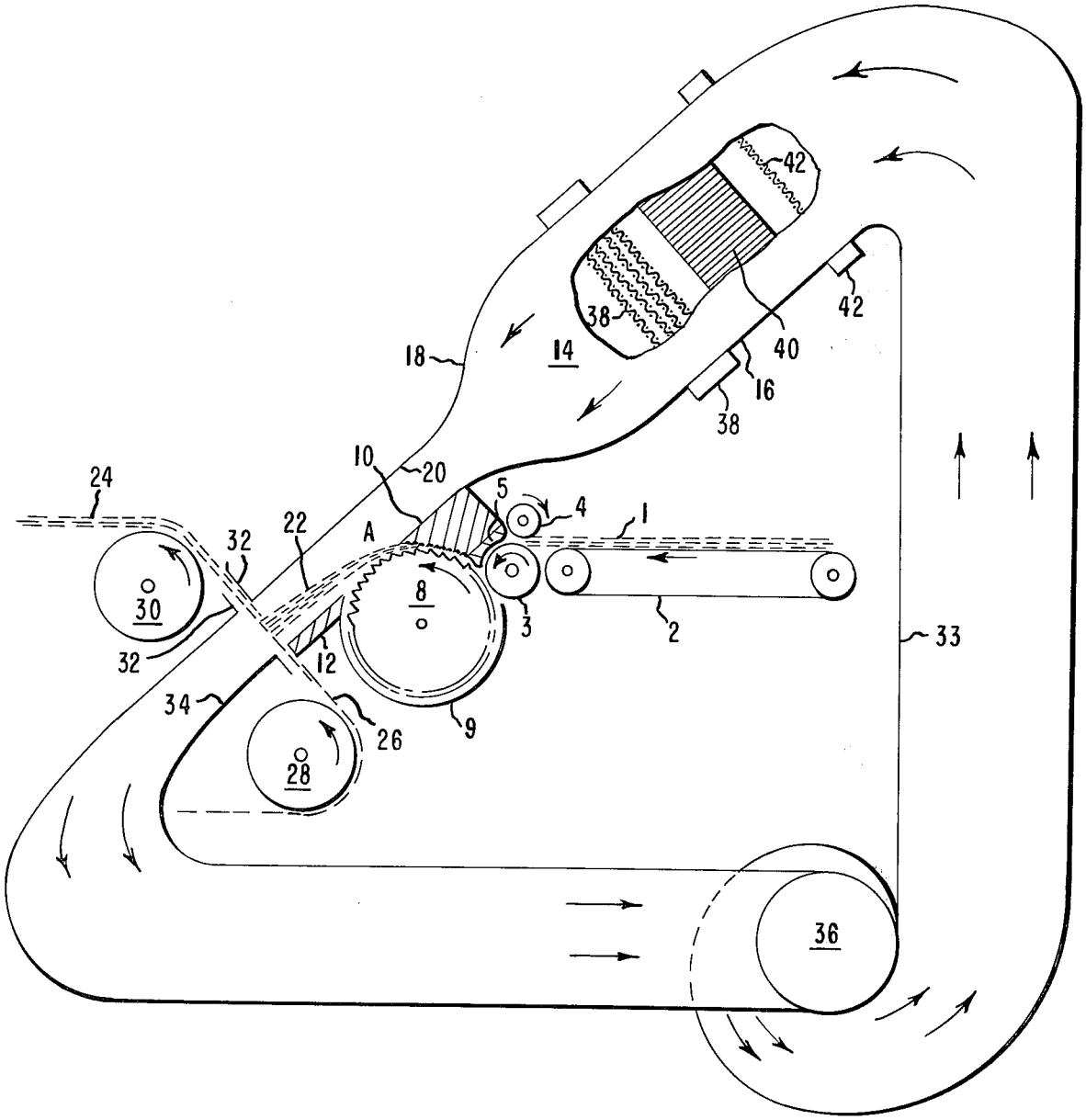
FIG. 1 is a longitudinal vertical section of a form of air-laydown machine to illustrate use of one embodiment of this invention.

Referring now to FIG. 1, there is shown a fiber feeding means consisting, in this embodiment, of a conveyor belt 2, feed roll 3, compressing roll 4 and shoe 5 for supplying fiber 1 to the disperser roll 8. The fiber feeding means is designed to feed a batt of staple fibers having a weight, in ounces per square yard, which is about 3 to 150 times the weight of the web to be produced. The disperser roll separates the fibers and carries them mixed with the air adjacent to the roll surface through the space between the roll and disperser plate 10, and discharges this mixture centrifugally into duct 20 at Zone A. A shroud or casing 9 extends around the disperser roll from the lower edge of doff-bar 12 to feed-roll 3. The fibers projected from the disperser roll form a thin fiber stream 22 in air flowing through the duct and are then separated from the air as web 24 on condenser screen 26.

Air is supplied from air passage 14, which has larger cross-sectional dimensions than the duct 20. The parallel walls 16 of the air passage are connected to the duct walls 20 by converging section 18 of the flow nozzle configuration. Screens 38 and 42, and honeycomb structure 40, provide a uniform flow substantially free of turbulence and vorticity. Air is blown into the air passage by one or more fans 36, through a duct system 33, shown diagrammatically.

The fibers are deposited to form a web on continuous, moving screen 26 which is driven and supported by rolls 28 and 30. The air flows through the screen and is withdrawn through vacuum duct 34. The air may be filtered to remove any particles passing screen 26 and then be recirculated to fan 36. Several fans in series or an open air system with one or more fans supplying the air and one or more fans exhausting the air can also be used. The screen 26 is sealed against the fiber duct 20 and the vacuum duct 34 by sealing means 32 as a plate of polyethylene.

FIG. 2 shows the disperser roll 8 and grooved plate 10 in greater detail. In the Figure, dashed line 58 is the tangent to the outer edge of the disperser roll teeth 7. The upper edge 54 of disperser plate 10 can be placed on the tangent line 58 or can be somewhat below the tangent line, e.g., ½ inch below. In the Figure, disperser plate 10 is shown to be provided with semicircular grooves 50 spaced uniformly, starting from the bottom of disperser plate 51 and ending as close as possible in the extreme tip 52 of the plate. Preferably, the grooves are present over the entire face, indicated generally at 56, of the plate except for the region 53, which extends ½ to ¾-inch from the extreme tip 52, to avoid weakening the tip. Preferably the extreme tip 52 of the disperser plate is rounded with a radius of at least 0.015 inch but less than about 0.06 inch. The face 56 of the disperser plate is essentially concentric with the disperser roll in its overall contour, i.e., not considering the grooves. The clearance 55 between the face 56 and the teeth 7 should be less than 0.125 inch in order to avoid premature turbulent mixing of air and fiber under the plate in an uncontrolled manner which would result in agglomeration of fibers into clumps. Preferably, a clearance of between about 0.01 and 0.06 inch is used.

Referring to FIG. 3, the dimensions of the grooved surface for the most preferred embodiment are shown in greater detail. The grooves are continuous in the lateral direction of the plate 10 and are spaced along the arc of the plate such that there are 0.05 to 50 grooves per inch of arc; grooved depth 60 is between 0.010 and 0.150 inch and groove width 61 between 0.010 and 1.00 inch; the distance 62 between the centerlines of adjacent grooves is between 0.02 and 2 inches and the land area 56 between adjacent grooves is between 0.001 and 1.5 inches.

FIGS. 4A through 4E show different types of grooves in disperser plates found to improve web uniformity. Dimensions of the grooves, referring to numbers given in FIG. 3, are given below:

| | PLATE IN FIGURE 4 | | | | |
|---|---|---|---|---|---|
| | 4A | 4B | 4C | 4D | 4E |
| Grooves/inch | 11 | ~8 | 11 | 5.5 | 10 |
| Depth (60) (in.) | 0.03 | 0.03 | 0.06 | 0.09 | 0.09 |
| Width (61) (in.) | 0.06 | 0.063 & 0.150 | 0.063 | 0.09 | 0.100 |
| Center-to-center (62) (in.) | 0.09 | 0.09 & 0.135 | 0.09 | 0.18 | 0.10 |
| Land area (56) (in.) | 0.03 | 0.03 | 0.03 | 0.09 | 0.005 |

Grooves of the same or similar configurations as in FIGS. 4A–4E, having dimensions within the general ranges listed previously in connection with FIG. 3, are also suitable.

The disperser roll 8 is of conventional design and is usually about 5 to 50 inches diameter. It is usually of hollow construction. The cylindrical outer surface of the roll is usually provided with low rake, fine metallic wire clothing 7 (FIG. 2) formed by spirally winding one or several saw-tooth strips about the roll and anchoring it. The sharp ends of the teeth are located so that the ends lie in a substantially true cylinder about the axis of rotation of roll 8. Typical arrangements include:

| | |
|---|---|
| Tooth rake : | Face angle within about 8° from radial direction. |
| Tooth length : | Shorter than ¼ inch, preferably about ⅛ inch. |
| Tooth ends : | Tip width less than 0.030 inch. |
| Tooth density : | Between about 8 and 350 teeth per square inch of roll surface. |

| Roll Diameter inches | Peripheral Speed (feet/minute) | Acceleration (times gravity) |
|---|---|---|
| 16 | 3000 to 20,000 | 117 to 5200 |
| 24 | 3600 to 24,000 | 112 to 5000 |
| 32 | 4200 to 30,000 | 115 to 5700 |

The disperser plate 10 and the doff bar 12 can be constructed of any suitable materials, such as plastic or metal, that will maintain the close clearance with the disperser roll 8 at the high speeds used. The disperser plate should have a length of at least ½ of the length of the staple fiber used but for mechanical convenience it may have a length corresponding to 45° to 90° or more of the arc of the disperser roll. Although a unitary disperser plate and doff bar are shown in FIG. 1, both parts can be fabricated of a number of sections with suitable attachments.

The following examples, which illustrate specific embodiments of this invention, are not intended to limit the invention in any way.

EXAMPLE 1

In this example, an apparatus, similar to that illustrated in FIG. 1, is used. In each of a series of runs, the feed to the disperser roll consists of 1.25-denier-per-fiber, ¾-inch-long, polyethylene terephthalate staple fibers in the form of a loosely opened 70 oz./yd.$^2$ batt. This is fed to a 24-inch diameter disperser roll having 80 teeth/square inch, each tooth being 0.090 inch high and 0.009 inch thick, and having a rake angle of 8degrees. The roll surface is provided with teeth by helically winding two toothed wires, started at one side of the roll, the first and second wires being started 180° apart, around the roll circumference. The clearance between the ends of the teeth of roll 8 and the land area 56 of curved plate 10 is maintained at 0.030 inch. The roll rotates at 2,500 rpm (surface vel. of 262 ft./sec.) and projects a uniform thin stream of fibers into the duct at an initial uniform velocity of 262 ft./sec. The average air velocity at the exit of the contoured nozzle connecting to rectangular duct 20 is about 175 ft./sec. with a turbulence intensity of about 0.5%. The velocity gradient across the width of the duct at this location is less than ±10% per foot. The approximate height dimensions of 40-inch wide rectangular duct 20 and the average air velocities at various locations in the duct are as follows:

| Location | Thickness (in.) | Velocity (ft./sec.) |
|---|---|---|
| X. Immediately downstream of nozzle (i.e., at entry to rectangular duct) | 2½ | 175 |
| a. Over plate 10 just upstream of disperser roll | 2¼ | 192 |
| b. At point of maximum intrusion of roll into duct | 1⅝ | 270 |
| c. Over plate 12, just downstream of disperser roll | 2 | 235 |
| d. Just upstream of collecting screen 26 | 2 | 224 |

The distance between locations X and *a* is about 8¼ inches; between *a* and *c* is about 10 inches; and between *c* and *d* is about 24½ inches. The fibers are projected into the duct at an initial angle to the air flow of about 16degrees and then conveyed in the air stream in a straight path to the collecting screen. At no location along the fiber path in the duct is the turbulence intensity greater than about 2%.

Using the above apparatus and operating conditions and using the same type of feed webs, the air laydown process is operated to produce webs with (A) a grooved disperser plate and (B) a smooth-surfaced disperser plate. The grooved plate has an aluminum face adjacent the disperser roll and continuous grooves of semicircular shape extending across the entire plate to within 0.75 inch of the plate tip. The disperser plate covers about ¼ of the roll circumference. The grooves are at right angles to the rotational direction of the roll and have the following dimensions:

| | |
|---|---|
| Groove depth(60) | 0.03 inch |
| Groove width(61) | 0.06 inch |
| Center-to-center distance(62) | 0.09 inch |
| Land area(56) | 0.03 inch |
| Grooves/inch | 11 (approx.) |

In one series, the process is carried out at a 9 lb./in.-hr. rate, to produce a web having a nominal weight of 1.2 oz./yd.$^2$ at a wind-up speed of 69–74 yards/minute. The web made with the grooved plate has greater uniformity than that made under the same conditions using a smooth plate.

The process is repeated using the grooved plate at the higher process rate of 16 lb./in.-hr., to produce a web of about 1.4 oz./yd.$^2$ at a wind-up speed of 110–115 yards/min. A web of good uniformity is made even at this high speed, indicating the superiority of the grooved plate.

EXAMPLE 2

This example illustrates the preparation of webs using (A) a grooved plate (B) a toothed plate and (C) a smooth-surfaced plate.

Apparatus, feed web, and operating conditions are the same as Example 1, using a 7–9 lb./in.-hr. rate to produce a web of about 1.2 oz./yd.$^2$, except as follows:

1. The disperser roll has a 24-inch diameter, 80 teeth/sq. in., each tooth being 0.090 inch high, 0.009 inch thick and having a rake angle of zero degrees. The toothed surface is provided by winding a toothed wire around the roll (single start winding).
2. A disperser roll speed of 3,000 rpm is used; i.e., roll surface velocity and hence, initial fiber velocity are 314 ft./sec. Three runs are made, one with each of the three plates. The grooved plate and the clearance from the disperser roll teeth for all plates are the same as that used in Example 1.

The toothed plate has 640 teeth/sq. inch, the teeth having the following dimensions:

| | |
|---|---|
| Height: | 0.123 inch |
| Thickness: | 0.009 inch |
| Rake Angle: | 12 degrees |

The most uniform web is that made with the grooved plate.

EXAMPLE 3

This example illustrates effect of percent turbulence, in the slit between the disperser roll and the disperser plate, on web quality, using (A) a grooved plate, (B) a toothed plate and (C) a smooth plate.

The air-laydown apparatus is similar to that of FIG. 1 and has the air flow characteristics of Example 1, except that the disperser roll diameter is 16 inches. The feed to the disperser roll consists of 1.25 dpf., ¾-inch long polyethylene terephthalate staple fibers in the form of a loosely opened 80 oz./yd.$^2$ batt. The air velocity over the disperser plate just upstream of disperser roll is about 173 ± 10 ft./sec.

The apparatus is used to produce 12-inch wide webs and is equipped with different disperser rolls and plates in a series of tests. All rolls have 80 teeth/inch$^2$, 0.090 inch high and 0.009 inch thick. Other roll surface characteristics are as follows:

Roll (1): The roll surface is provided with teeth by helically winding a total of 8 toothed wires, started at one side of the roll at 45° intervals around the roll circumference. The 8 wires consist of four wires of 0.090 inch height and four of shorter height. They are wound alternately. Each tooth has a rake angle of 0°.

Roll (2): The roll surface is provided with teeth by helically winding one continuous and toothed wire, started at one side of the roll, around the roll circumference. Each tooth has a rake angle of 0°.

Roll (3): The roll surface is provided with teeth by helically winding 11 continuous and toothed wires, started at one side of the roll at 11 equal intervals (~ 33 degree interval) around the roll circumference. Each tooth has a rake angle of 15°.

Roll (4): The roll surface is provided with teeth by helically winding one continuous and toothed wire, started at one side of the roll around the roll circumference. The teeth consist of 2 shapes: sharp-point teeth and flat-top teeth.

Roll (5): The roll surface is provided with teeth by helically winding four continuous and toothed wires, started at one side of the roll, at 90° intervals, around the roll circumference. The four wires consist of two sets of different heights (0.090 inch and shorter height). They are wound alternately. Each tooth has a rake angle of 8°.

The grooved plate used has the same groove dimensions as the plate in Example 1. Exceptions are: (1) a 12-inch width vs. the 36-inch used in Example 1; and (2) the arc length of the plate is about 10.5 inches vs. 17 inches for that used in Example 1. The plates cover about one-fourth of the rolls in both cases.

The toothed plate (640 teeth/in.$^2$) is as follows: The side of the disperser plate facing the rotating disperser roll is clothed with sawtooth wires in the circumferential direction covering approximately 80% of the arc length. There are 20 teeth per inch and the wire density is 32 per inch.

The percent turbulence values in the slit between the disperser roll and the plate for the different roll/plate combinations are measured using the technique described hereinafter and are reported in Table I along with web-uniformity ratings (1 to 5, poorest to best) for each of 3 different types of nonuniformities: (1) chatter, i.e., lines in cross-direction of web; (2) blotchiness; and (3) streaks in machine direction of web. Ratings are given for each roll/plate combination at 2 different roll speeds (4,500 rpm, i.e, 314 ft./sec. surface speed and 3,000 rpm., i.e., 209 ft./sec. surface speed). The web-take-away speed is increased from 72 ypm to 100 ypm as the roll rpm is increaed from 3000 to 4500 rpm so that the chatter spacing (or the ratio of take-away speed to rpm) is kept approximately the same.

In this series it is found that web uniformity generally improves with percent turbulence, with the most uniform webs being made with the grooved plate (% turbulence of 28–40).

EXAMPLE 4

This example illustrates the difference in air pulsation and percent turbulence in the disperser roll plate slit when using different plates.

Two runs are made using the apparatus and process conditions of Example 3 and disperser roll (3) of Example 3. The disperser roll speed used is 4,500 rpm. One run is made with (A) the grooved plate having the geometry shown in FIG. 4C; the second run (B) is made with a smooth plate.

Tracings are made of the signals generated by air pulsating in the slit during each run. A hot wire anemometer and a real time (signal-frequency) analyzer are used to obtain the tracings as described in detail hereinafter. The tracing obtained when using the smooth plate has a predominant signal (high peak) corresponding to roll frequency, i.e., high peak per each roll revolution. Correspondingly, the web obtained when using this smooth plate, shows a transverse line or socalled chatter mark across the web width which correspondingly occurs once per each roll revolution.

The tracing obtained when using the grooved plate shows several approximately equal peaks or else there are peaks of higher amplitude than the roll-frequency-peak, occurring at high harmonics (i.e., occurring at 2, 3, or 4 times the roll frequency). This multicycle type of air-pulsation (as opposed to one pulsation per roll revolution) together with high percent turbulence (36% for grooved plate vs. 19% for smooth plate) which is made of high amplitude signal at high frequency disperses fibers better and thereby eliminates the chatter marks which would otherwise form. Hot wire anemometer signals filtered at 1 M Hz from the smooth and grooved plates in the time domain show that there are stronger pulsations at high frequencies with the grooved plate. The web obtained under these conditions using the grooved plate is found to have no chatter marks and greatly improved blotch levels and no streaks.

EXAMPLE 5

This example illustrates effect of geometry, percent turbulence in the slit between the disperser roll and the disperser plate, and the arc length of the grooved portion in the disperser plate on web quality.

The air-laydown apparatus and conditions used are identical to those of Example 3 except as follows:

1. Various groove geometries as shown in FIG. 4 are used.
2. Combinations of the grooved disperser plate tip and the smooth disperser plate are also used.

The percent turbulence and the web ratings ae tabulated in Tables II and III. In this series it is found that: (1) although the web quality improves with higher percent turbulence, the effect of geometry is as important, and (2) the plate with grooves extending to the full arc length appears to give better web uniformity and higher percent turbulence.

Percent Turbulence Measurements

By "percent turbulence" or turbulence intensity is meant the root mean square value of the air velocity fluctuation divided by the mean air velocity, as determined using a hot wire anemometer by standard techniques. A suitable instrument for this purpose, which was used for the measurements reported herein, is a Model 1050 B-4 hot-wire anemometer, manufactured by Thermal Systems Inc., of St. Paul, Minnesota.

When the output of the anemometer is also passed to an AC coupled, root-mean-square (RMS) voltmeter, such as a Model 3400A, manufactured by Hewlett Packard, Inc. of Loveland, Colorado, the RMS value of the velocity fluctuation in the direction of air flow with time is measured. For the values reported herein, the RMS readings were averaged for about 5 to 10 seconds. The RMS value of the velocity fluctuation, multiplied by 100 and divided by the average velocity at that location is referred to herein as the percent turbulence or the local turbulence intensity. Further details on the use of hot-wire anemometers for measuring velocity and turbulence intensity is given in numerous places in the art, such as Bulletin 53, "The Hot-Wire Anemometer", of Flow Corporation of Cambridge, Massachusetts. Theoretical discussions of turbulence intensity are found in H. Schlichting, "Boundary Layer Theory", 6th Ed., McGraw Hill Book Company, New York, 1968, pages 455–457, 538–539, 558, etc.

In making the measurements in the slit between the disperser roll and the disperser plate, a hot-wire probe is introduced through a hole (9/32 inch diameter) in the disperser plate tip and is lowered to a reference position, i.e., where the mean velocity measured is about 110 ft./sec., when the roll surface speed is 315 ft./sec. The hole should be sufficiently inward from the tip of the plate to avoid end effects. This reference position is used for all subsequent hot-wire measurements.

Such measurements typically show the generation of air fluctuations of higher amplitude and frequency, when an unsmooth (grooved or toothed) plate is used, than are generated when a smooth plate is used. These pulsations correspond to higher percent turbulence values for unsmooth than for smooth plates, the exact percent values being also dependent on the type of disperser roll used in combination with the plate (i.e., the surface characteristics of the roll also have a bearing on the percent turbulence values for a given roll/-plate combination.

Frequency Analysis

Frequency analysis of the hot-wire anemometer output is performed using a model SD 301b Real Time Analyzer (abbreviated RTA) sold by Spectral Dynamics Corp. of San Diego, California described in their instruction manual, Sections 3.1 to 3.4 (Instruction Manual SD 301B, Real Time Analyzer, pp 3-1 through 3-60, June, 1970). The SD301B RTA operates as a frequency-tuned band-pass filter to convert the input signal (hot-wire anemometer output signal) from the time domain to the frequency domain RMS (root mean square) voltage values. The RMS voltage values of the pulsation amplitudes at various frequencies are traced on an oscilloscope, using the RMS values of voltage as the ordinate of the plot and the frequency values as the abscissa. Analysis is normally done using 0-500 and 0-5000 Hz as the frequency base, for convenience, but could be done at any other frequency range. The roll frequencies of interest range from 25 to 75 Hz. Voltage output is calibrated so that 6.71 volts is equal to 200 ft./second.

TABLE I

| | | EXAMPLE 3A — Grooved Plate | | | | EXAMPLE 3B — Toothed Plate | | | | EXAMPLE 3C — SMOOTH PLATE | | | |
|---|---|---|---|---|---|---|---|---|---|---|---|---|---|
| | | Web Rating* | | | | Web Rating* | | | | Web Rating* | | | |
| Roll | Roll r.p.m. | Chatter | Blotches | Streaks | % Turbulence | Chatter | Blotches | Streaks | % Turbulence | Chatter | Blotches | Streaks | % Turbulence |
| 1 | 4,500 | 5.0 | 4.3 | 5.0 | 34 | 5.0 | 4.0 | 4.0 | 19 | 5.0 | 2.5 | 2.5 | 12.4 |
| | 3,000 | 5.0 | 4.8 | 4.8 | 39.5 | 5.0 | 3.5 | 4.0 | 20.6 | 5.0 | 3.0 | 3.5 | 17.3 |
| 2 | 4,500 | 3.7 | 3.6 | 4.25 | 28.4 | 2.5 | 3.8 | 4.0 | 23.0 | 3.0 | 2.3 | 3.0 | 17.9 |
| | 3,000 | 4.0 | 4.2 | 4.0 | 30.0 | 3.0 | 4.0 | 3.8 | 22.4 | 4.0 | 3.5 | 2.5 | 16.2 |
| 3 | 4,500 | 5.0 | 4.0 | 5.0 | 31.8 | 5.0 | 4.5 | 5.0 | 21.0 | 3.5 | 2.0 | 4.0 | 18.7 |
| | 3,000 | 5.0 | 4.3 | 5.0 | 34.5 | 5.0 | 3.5 | 4.0 | 24.5 | 5.0 | 2.5 | 4.0 | 21.0 |
| 4 | 4,500 | 4.5 | 3.5 | 4.5 | 40.0 | | | | | 5.0 | 2.0 | 4.0 | 19.1 |
| | 3,000 | 4.5 | 3.8 | 4.5 | 28.5 | | | | | 5.0 | 3.0 | 4.5 | 21.5 |
| 5 | 4,500 | 4.5 | 3.5 | 4.5 | 30.3 | | | | | 4.5 | 2.5 | 3.5 | 20.9 |
| | 3,000 | 4.5 | 4.0 | 4.5 | 31.4 | | | | | 4.0 | 3.5 | 4.0 | 20.8 |

*5 = excellent (No chatter, No streaks, No blotches)
1 = very poor (severe chatter, severe streaks, severe blotchiness) Web basis weights of the samples are kept at ~1.2 oz./yd.$^2$. Throughputs corresponding to 4,500 and 3,000 rpms are 12.5 and 9 lb./hr.-in., respectively.

TABLE II

| | EXAMPLE 5 GROOVED DISPERSER PLATE AND TIP | | | | | | | | |
|---|---|---|---|---|---|---|---|---|---|
| | EXAMPLE 5A — SMOOTH SURFACE | | | | | EXAMPLE 5B — GROOVES — FIG. 4A | | | |
| | | Web Rating* | | | | Web Rating* | | | |
| Roll | RPM | Chatter | Blotch | Streak | %** Turbulence | Chatter | Blotch | Streak | %** Turbulence |
| 1 | 4,500 | 5.0 | 2.5 | 2.5 | 12.4 | 5.0 | 4.3 | 5.0 | 34.0 |

TABLE II-continued

| | | EXAMPLE 5 GROOVED DISPERSER PLATE AND TIP | | | | | | | |
|---|---|---|---|---|---|---|---|---|---|
| | | EXAMPLE 5A — SMOOTH SURFACE | | | | EXAMPLE 5B — GROOVES — FIG. 4A | | | |
| | | Web Rating* | | | | Web Rating* | | | |
| Roll | RPM | Chatter | Blotch | Streak | %** Turbulence | Chatter | Blotch | Streak | %** Turbulence |
| | 3,000 | 5.0 | 3.0 | 3.5 | 17.5 | 5.0 | 4.8 | 4.8 | 39.3 |
| 2 | 4,500 | 2.8 | 2.2 | 3.0 | 17.6 | 4.1 | 3.6 | 4.4 | 27.4 |
| | 3,000 | 3.5 | 3.8 | 2.5 | 18.4 | 4.3 | 4.4 | 4.3 | 28.7 |
| 3 | 4,500 | 3.5 | 2.0 | 4.0 | 20.5 | 5.0 | 4.0 | 5.0 | 32.5 |
| | 3,000 | 5.0 | 2.5 | 4.0 | 23.3 | 5.0 | 4.3 | 5.0 | 34.0 |
| | | EXAMPLE 5C — GROOVES — FIG. 4B | | | | EXAMPLE 5D — GROOVES — FIG. 4C | | | |
| 1 | 4,500 | 5.0 | 3.0 | 4.8 | 23.7 | 5.0 | 4.0 | 5.0 | 25.5 |
| | 3,000 | 5.0 | 4.0 | 5.0 | 28.2 | 5.0 | 4.3 | 5.0 | 28.0 |
| 2 | 4,500 | 3.5 | 3.5 | 3.0 | 29.5 | 4.0 | 3.5 | 4.0 | 23.8 |
| | 3,000 | 4.0 | 3.5 | 4.0 | 26.1 | 4.8 | 3.5 | 4.8 | 22.0 |
| 3 | 4,500 | 5.0 | 4.0 | 5.0 | 36.2 | 5.0 | 4.5 | 5.0 | 30.4 |
| | 3,000 | 5.0 | 4.8 | 5.0 | 50.4 | 5.0 | 4.8 | 5.0 | 33.0 |

*5 = excellent (no chatter, no streaks, no blotches)
1 = very poor (severe chatter, severe streaks, severe blotchiness) Web basis weights of the samples are kept at ~1.2 oz./yd.$^2$. Throughputs corresponding to 4,500 and 3,000 rpms are 12.5 and 9 lb./hr.-in., respectively. (Web rating ± 0.25)

**± 2%

TABLE III

| | | EXAMPLE 5 SMOOTH DISPERSER PLATE USED WITH GROOVED DISPERSER PLATE TIP | | | | | | | |
|---|---|---|---|---|---|---|---|---|---|
| | | EXAMPLE 5E, TIP GROOVES OF FIGURE 4A | | | | EXAMPLE 5F, TIP GROOVES OF FIGURE 4B | | | |
| Roll | RPM | Chatter* | Blotch* | Streak* | % Turbulence** | Chatter* | Blotch* | Streak* | % Turbulence** |
| 1 | 4,500 | | | | | 5.0 | 3.5 | 5.0 | 22.6 |
| | 3,000 | | | | | 5.0 | 4.0 | 5.0 | 24.2 |
| 2 | 4,500 | | | | | 2.5 | 3.5 | 3.0 | 29.0 |
| | 3,000 | | | | | 3.5 | 4.0 | 3.5 | 24.3 |
| 3 | 4,500 | 5.0 | 3.0 | 3.75 | | 5.0 | 4.5 | 5.0 | 30.0 |
| | 3,000 | 5.0 | 3.25 | 3.75 | | 5.0 | 4.75 | 5.0 | 30.4 |
| | | EXAMPLE 5G, TIP GROOVES OF FIGURE 4C | | | | EXAMPLE 5H, TIP GROOVES OF FIGURE 4D | | | |
| 1 | 4,500 | 5.0 | 3.5 | 4.0 | 24.2 | 5.0 | 3.5 | 4.0 | 18.3 |
| | 3,000 | 5.0 | 4.0 | 4.0 | 20.3 | 5.0 | 4.0 | 3.5 | 24.3 |
| 2 | 4,500 | 3.0 | 3.5 | 3.5 | 18.0 | 4.5 | 3.0 | 4.0 | 21.2 |
| | 3,000 | 3.5 | 4.0 | 4.0 | 19.0 | 4.5 | 3.25 | 4.0 | 22.3 |
| 3 | 4,500 | 5.0 | 4.5 | 5.0 | 22.6 | 5.0 | 4.5 | 4.5 | |
| | 3,000 | 5.0 | 4.75 | 5.0 | 25.0 | 5.0 | 4.5 | 5.0 | |
| | | EXAMPLE 5I - TIP GROOVES OF FIGURE 4E | | | | | | | |
| 1 | 4,500 | 5.0 | 3.25 | 3.5 | 28.0 | | | | |
| | 3,000 | 5.0 | 4.0 | 3.0 | 27.9 | | | | |
| 2 | 4,500 | 4.5 | 3.25 | 4.0 | 30.0 | | | | |
| | 3,000 | 4.5 | 3.25 | 3.0 | 30.0 | | | | |
| 3 | 4,500 | 5.0 | 4.0 | 5.0 | | | | | |
| | 3,000 | 5.0 | 4.0 | 5.0 | | | | | |

*5 = excellent(no chatter, no streaks, no blotches)
1 = very poor (severe chatter, severe streaks, severe blotchiness) Web basis weights of the samples are kept at ~1.2 oz./yd.$^2$. Throughputs corresponding to 4,500 and 3,000 rpms are 12.5 and 9 lb./hr.-in., respectively. (Web rating ± 0.25)

** ± 2%

We claim:

1. In an air-laydown apparatus for forming a web of staple fibers which comprises duct means for conveying fibers in a stream of air, a rotating toothed disperser roll and coacting stationary disperser plate for projecting fibers through an opening in the duct means to form a stream of fibers in the stream of air, condenser means for separating the fibers from the air to form a web, and air supply means which includes a highly uniform air passage with a larger cross-sectional area than said duct means connected directly to the duct means by a converging section in the form of a smooth, gradual curve, in combination with screens and a honeycomb structure located in the larger air passage to provide a uniform flow substantially free of turbulence and vorticity; the improvement for high speed production of highly uniform webs which comprises grooves in the stationary disperser plate extending across the plate in a direction transverse to the rotational direction of the roll for generating a high intensity of air turbulence between the disperser roll and plate, the percent turbulence being at least 25 when the roll is rotating at a surface speed of about 315 feet per second.

2. The apparatus defined in claim 1 wherein the grooves are semicircular in shape and extend continuously across the plate.

3. The apparatus defined in claim 2 wherein the grooves are present over substantially the entire surface of the disperser plate.

* * * * *